United States Patent [19]

Höffgen

[11] Patent Number: 4,670,958

[45] Date of Patent: Jun. 9, 1987

[54] EXTRACTING DEVICE FOR A GAS-PURGE BRICK

[75] Inventor: Hans Höffgen, Höhr-Grenzhausen, Fed. Rep. of Germany

[73] Assignee: Radex Deutschland Aktiengesellschaft für feuerfeste Erzeugnisse, Urmitz bei Koblenz, Fed. Rep. of Germany

[21] Appl. No.: 726,692

[22] Filed: Apr. 22, 1985

Related U.S. Application Data

[63] Continuation of PCT DE 84/00168 filed on Aug. 16, 1984, published as WO 85/01068 on Mar. 14, 1985, now abandoned.

[30] Foreign Application Priority Data

Aug. 20, 1983 [DE] Fed. Rep. of Germany ..... 3330105
Jan. 25, 1984 [DE] Fed. Rep. of Germany ..... 3402444

[51] Int. Cl.[4] ..... B23P 19/04

[52] U.S. Cl. ..... 29/252; 266/220; 432/76

[58] Field of Search ..... 29/252, 263, 264, 265, 29/280, 255; 254/29 A; 266/220; 110/338, 339; 432/2, 3, 76

[56] References Cited

U.S. PATENT DOCUMENTS 2,573,567 10/1951 Hancock ..... 29/252
2,866,370 12/1958 Biach ..... 254/29 A
3,029,501 4/1962 Leathers ..... 29/252

*Primary Examiner*—Robert C. Watson
*Attorney, Agent, or Firm*—Browdy & Neimark

[57] ABSTRACT

A device is provided for extracting a sheet-metal-encased gas-purge brick from a perforated brick or a perforated-brick sleeve simply, quickly and without causing any appreciable contamination. The device consists of a frame adapted to rest upon the exterior of the perforated brick, upon the perforated-brick sleeve, or upon the outer wall of a metallurgical vessel; a drawbar displaceable axially in the frame in relation to the metallurgical vessel and adapted to be set up in alignment with the centerline of the gas-purge brick; a device,provided on the drawbar, for coupling the end thereof to the gas-purge brick; and a driving means for displacing the drawbar in a direction away from the perforated brick. The coupling device consists of a coupling part seated upon the drawbar; a counter-coupling part secured to the gas-purge brick; and a coupling pin adapted to be passed through aligned holes in the two coupling parts.

27 Claims, 5 Drawing Figures

EXTRACTING DEVICE FOR A GAS-PURGE BRICK

Continuation of PCT DE 84/00168 filed on Aug. 16, 1984, published as WO 85/01068 on Mar. 14, 1985, now abandoned.

The invention relates to a device for extracting a sheet-metal-encased gas-purge brick from a perforated brick or a perforated-brick sleeve, and to a gas-purge brick which is adapted to the said extracting device.

In modern steel plants sets of gas-purge bricks are frequently inserted into the bottoms or lateral walls of metallurgical vessels, in order to treat the melts with suitable purging gases. These gas-purging bricks wear out and must be replaced from time to time. Extraction of the worn gas-purge bricks from the perforated brick or perforated-brick sleeve is a matter of considerable difficulty. In the case of sheet-metal-encased gas-purge bricks, which cannot be immediately loosened, the bottom of the purge brick being welded-on, the brick must be driven out from the outside, and the sheet-metal must then be burned off the casing. This is a tedious and awkward job and a very dirty job for the crew.

It is therefore an object of the invention to provide an extracting device by means of which gas-purge bricks can be removed from the perforated brick or perforated-brick sleeve simply, quickly and without appreciable contamination.

According to the invention, this object is achieved with a device comprising a frame adapted to rest upon the exterior of the perforated brick, upon the perforated-brick sleeve, or upon the outer wall of the metallurgical vessel; a drawbar displaceable axially in the frame in relation to the metallurgical vessel and adapted to be disposed in alignment with the centerline of the gas-purge brick; a device, provided on said drawbar, for coupling the end thereof to said gas-purge brick; and a driving means for displacing said drawbar in a direction away from the perforated brick.

In order to release a gas-purge brick, the frame of the device need only be placed upon the perforated brick, upon the perforated-brick sleeve, or upon the outer wall of the metallurgical vessel; the drawbar is then connected to the gas-purge brick with the aid of the coupling device, after which said drawbar is actuated by the driving means; the purge brick then moves automatically out of the perforated brick or perforated-brick sleeve. This method is very easily implemented and can be carried out in a very short time without heavy contamination.

The coupling device preferably comprises a coupling part provided at the end of the drawbar and having at least one hole disposed at right angles thereto, a counter-coupling part provided on the sheet-metal end of the gas-purge brick and also having at least one hole disposed at right angles to the axis of the purge-brick; and a coupling pin adapted to be passed through the holes in alignment with each other.

The coupling part on the drawbar may be provided with a cylindrical end-section having two holes in alignment with each other thereby to provide good retention.

The counter-coupling part, fitted to the gas-purge brick, is preferably in the form of a cylinder which has two holes in alignment with each other and is longer than the gas-connecting pipe which it concentrically surrounds, the distance between the said holes and the sheet-metal end of the gas-purge brick being greater than the length of the gas-connecting pipe. This makes it a simple matter to insert the coupling pin through the two coupling parts without interference with the gas-connecting pipe.

The inside diameter of the cylindrical end-section of the coupling part provided on the drawbar is greater than the outside diameter of the cylindrical counter-coupling part fitted to the purge-brick. This allows the coupling part on the drawbar to be slipped over the counter-coupling part on the gas-purge brick.

The frame of the device is preferably in the form of a tripod, with the three legs being connected to the central guide-sleeve for the drawbar. A frame of this kind is stable and rests conveniently upon any surface.

The holder for accommodating the driving means which displaces the drawbar may be provided on the frame adjacent the guide-sleeve. The driving means is preferably a hollow piston-cylinder actuated by compressed gas and arranged in alignment with the guide-sleeve, through which the drawbar extends, said drawbar being adapted to be locked on or in the hollow piston at least during the extraction process.

The drawbar may be in the form of a threaded spindle which carries, on the end projecting from the hollow piston and remote from the coupling device, a handwheel provided with a corresponding internal thread which is adapted to be screwed towards the end-face of the hollow piston and can be brought to bear upon a bearing surface on the end-face thereof. This makes it possible to use said handwheel to lock the drawbar in relation to the said hollow piston.

According to another embodiment of the device according to the invention, the coupling device has been varied. In this second embodiment one of the coupling parts is provided with at least two radial studs inserted into the cylindrical wall and projecting inwardly and/or outwardly, and the other coupling part comprises a corresponding number of slots running from the outer end, of suitable width for the accommodation of said studs, and arranged in equal peripheral distribution, each of the said slots running initially approximately axially and then running at right angles, in the peripheral direction, for more than one stud-diameter, the said coupling parts being adapted to slide freely one into the other and to be locked together. It is possible with this device, regardless of the position of the studs and slots to be locked together, to slide the coupling parts one into the other until the studs come to a stop against the end-face of the counter-coupling part, and then to rotate the coupling part connected to the drawbar, preferably in the direction of the curved part of the slot, with light pressure, in relation to the coupling part connected to the gas-purge brick, until the studs automatically reach the axial parts of the slots and, by engaging in the curved parts thereof, lock the said coupling parts together.

The foregoing configuration of the coupling device substantially simplifies the fitting of the drawbar to the gas-purge brick and also makes it possible to dispense with the loose part in the form of the previously necessary coupling pin which is easily mislaid. Sundry particularly satisfactory configurations of the present invention appear in the contents of the sub-claims and will be explained hereinafter. The coupling part containing the studs may slip over or into the counter-coupling part. The studs must therefore be arranged either to project substantially into the interior of the coupling part and to extend from outside into the slots in the countercoupling parts, or to project outwardly beyond the coupling part and to extend outwardly from the slots.

Since according to the invention, the studs are made of pieces of steel rod secured by welding to the cylindrical coupling part, inwardly projecting studs greatly assist in the production of the coupling part, whereas outwardly projecting studs facilitate the locking process since they provide optical monitoring of the relative positions of the studs and slots, although this is not strictly necessary.

Introduction of the studs into the slots is facilitated according to the invention by widening the ends of the slots and this also simplifes the locking process.

In order to protect the lock, in its terminal position against inadvertent rotation and thus becoming unlocked, according to a preferred embodiment the ends of the slots are provided with bulges in which the studs can engage. As soon as the drawbar is then locked to the perforated brick, the connection can no longer become loose.

The configuration of the coupling device according to the invention has the special advantage of making it possible to design the gas-connecting pipe to project from inside beyond the counter-coupling part arranged on the gas-purge brick. This makes it easier to install a gas-supply line without in any way impairing the coupling of the drawbar. Since the drawbar rests upon the outer wall of the vessel by means of its frame and is axially displaceable in relation thereto, it is particularly advantageous to design the drawbar as a threaded spindle and to equip it with a handwheel which can bear upon a stationary or displaceable part of the frame and can be locked in relation to the said spindle. In this connection, the said handwheel may be spaced from the frame and may be locked to the drawbar, thus making it possible to lock the coupling parts by axial displacement and rotation of the said handwheel. This again improves the functioning of the coupling device. The means for locking the handwheel to the drawbar is preferably in the form of a transverse hold in the handwheel, an elongated hole in the drawbar, and an insertable split-pin. The elongated hole facilitates alignment of the openings thorugh which the splitpin must pass. After the coupling parts have been locked, the split-pin may be withdrawn and the handwheel may be brought to bear upon the frame. Further rotation of the handwheel then extracts the gas-purge brick. As an alternative however, it is also possible to cause the handwheel to bear only lightly against the frame and thereafter to displace the corresponding part, for example in the form of a piston, within the frame, in order to extract the gas-purge brick. Particularly suitable for this purpose is a piston-cylinder arrangement hydraulically or pneumatically operated, with a stroke of specific length within the frame.

The invention is explained hereinafter in detail and is illustrated by way of example in the drawing attached hereto, wherein.

Figure 1:
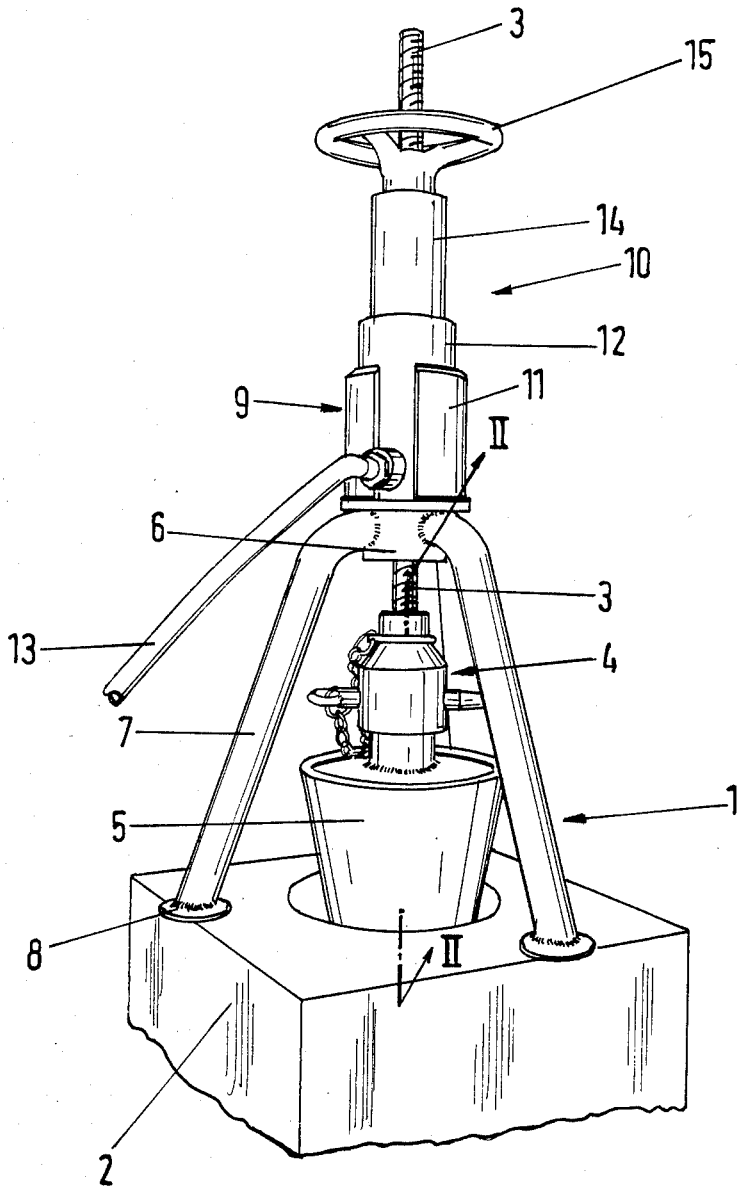
FIG. 1 is a perspective view of an embodiment of an extraction-device which is coupled to a gas-purge brick and is resting upon a perforated brick.
Figure 2:
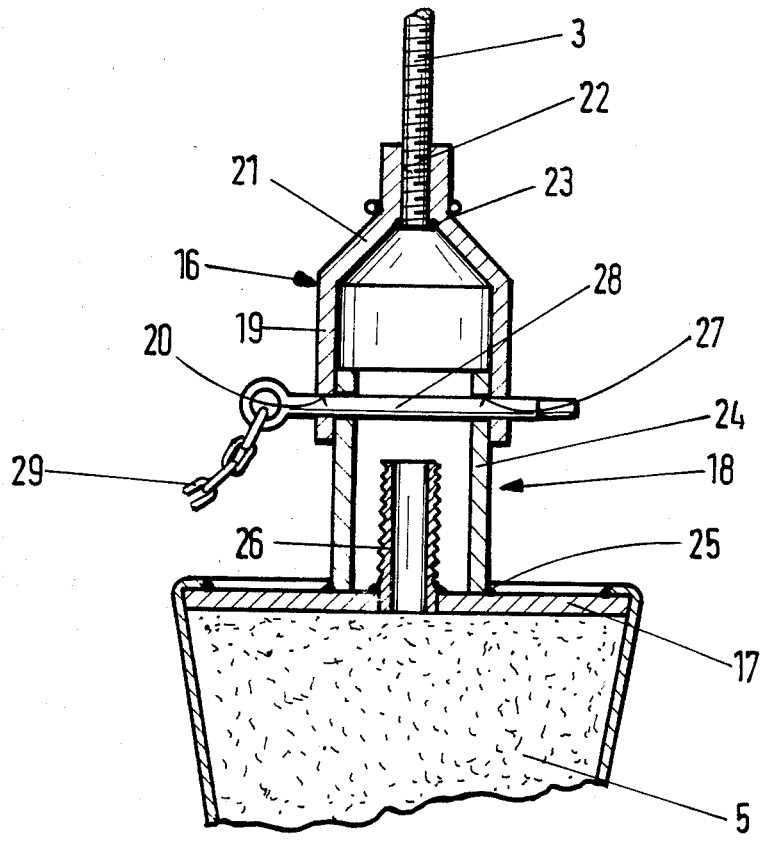
FIG. 2 is a cross-section along the line II—II in FIG. 1, to an enlarged scale.

According to FIGS. 1 and 2 of the drawing, the extraction device consists essentially of a frame 1 which rests upon a perforated brick 2, upon a perforated-brick sleeve, or also upon the outer wall of a metallurgical vessel (not shown in the drawing); a drawbar 3 guided in the said frame and which is adapted to be driven at least in the direction away from the perforated brick 2; and a coupling device 4 adapted to be secured to the said drawbar at a gas-purge brick 5 provided with a sheet-metal casing. Frame 1 comprises a central guide-sleeve 6 in which the drawbar is longitudinally displaceable. Seated upon the guide-sleeve 6 are three supporting legs 7 arranged at 120° to each other, the lower ends of the said legs being provided with bearing plates 8 so that the said frame may rest conveniently upon the perforated brick 2 or upon the outer wall of the metallurgical vessel. The said frame also comprises a holder 9 for the accommodation of a driving means 10 which displaces the said drawbar longitudinally. The said holder is in the form of a slotted cylinder 11 in which is seated a hollow piston-cylinder 12 acting as the driving means. In the present case all that is needed is a single-acting hollow piston-cylinder to one end of which pressure is applied through a feedline 13.

The drawbar 3, which runs in the guide-sleeve 6 and is in the form of a threaded spindle in the present embodiment, extends through the central aperture in the hollow piston 14, the end of the said drawbar extending from the said hollow piston and carrying a handwheel 15 which can be rotated upon the said drawbar, which is in the form of a threaded spindle, toward the end-face of the said hollow piston against which it can be brought to bear.

By actuating the single-acting hollow piston-cylinder 12, the drawbar 3 is displaced axially by pressure and by the handwheel 15.

Coupling device 4 consists of a coupling part 16 provided at one end of the drawbar 3 and a counter-coupling part 18 seated upon sheet-metal end 17 of the gas-purge brick 5. The coupling part 16, seated upon the drawbar 3, is bell-shaped and comprises a cylindrical end-section 19 with two holes 20 in alignment with each other on diametrically opposite sides of the said end-section. Restricted section 21 of the bell-shaped coupling prt 16 has a central threaded hole 22 by means of which the said coupling part is screwed to the drawbar 3 in the form of a threaded spindle. A weld 23 secures the said spindle to the said coupling part so that it cannot rotate in relation thereto.

The counter-coupling part 18 is in the form of a cylinder 24, one end of which is welded at 25 to the sheet-metal end 17 of the gas-purge brick. The coupling cylinder 24 surrounds gas-connecting pipe 26 leaving sufficient room for connecting the gas supply line. Moreover, the said coupling cylinder is longer than the gas connecting pipe 26 seated upon sheet-metal end 17, the end of the said coupling, projecting beyond the said gas-connecting pipe, having two holes in alignment with each other on diametrically opposite sides, with the said holes being of approximately the same diameter as the holes provided in the coupling part 16.

The outside diameter of the coupling cylinder 24 is somewhat smaller than the inside diameter of the cylindrical end-section 19 of the coupling part 16, so that the latter may be slipped over the former. When holes 20 and 27 have been aligned with each other, a coupling pin 28 is passed through the four holes, thus providing a positive connection between the drawbar 3 and the gas-purge brick 5. Coupling pin 28 may be secured to coupling part 16 by means of a chain 29, so that it will not be lost.

In order to extract a gas-purge brick 5 from a perforated brick, the frame 1 is placed with its three legs 7 upon the perforated brick 2 or upon the outer wall of the relevant metallurgical vessel, whereupon the drawbar is displaced towards the brick 2 until the coupling part 16 engages over the coupling cylinder 24 and the coupling pin 28 can be inserted. The handwheel 15 is then rotated towards the hollow piston-cylinder 12 until it bears upon the end-face of the hollow piston 14. Pressure is then applied to the cylinder 12 through the feedline 13, causing the hollow piston 14 to emerge from the cylinder 12 and to carry the drawbar along with the handwheel. This displacement of the drawbar 3 automatically extracts the coupled purge brick 5 from the perforated brick 2.

Figure 3:
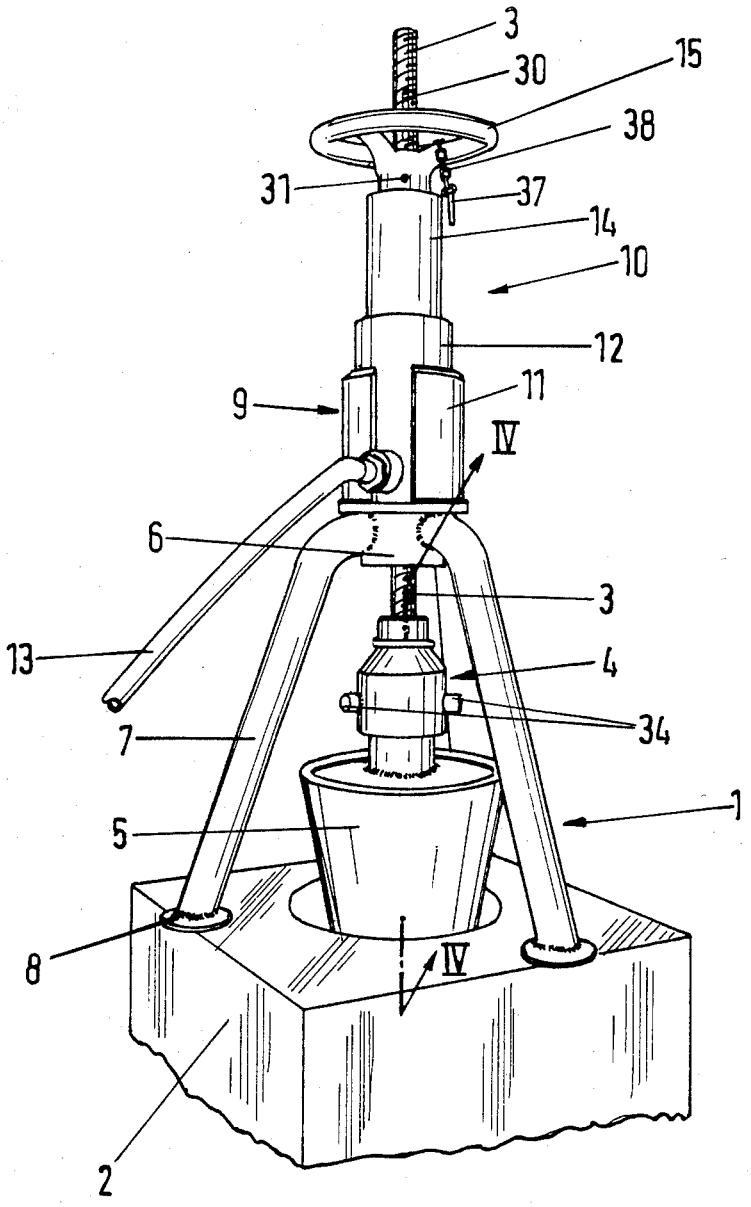
FIG. 3 is another embodiment of an extraction-device similar to the representation in FIG. 1.
Figure 4:
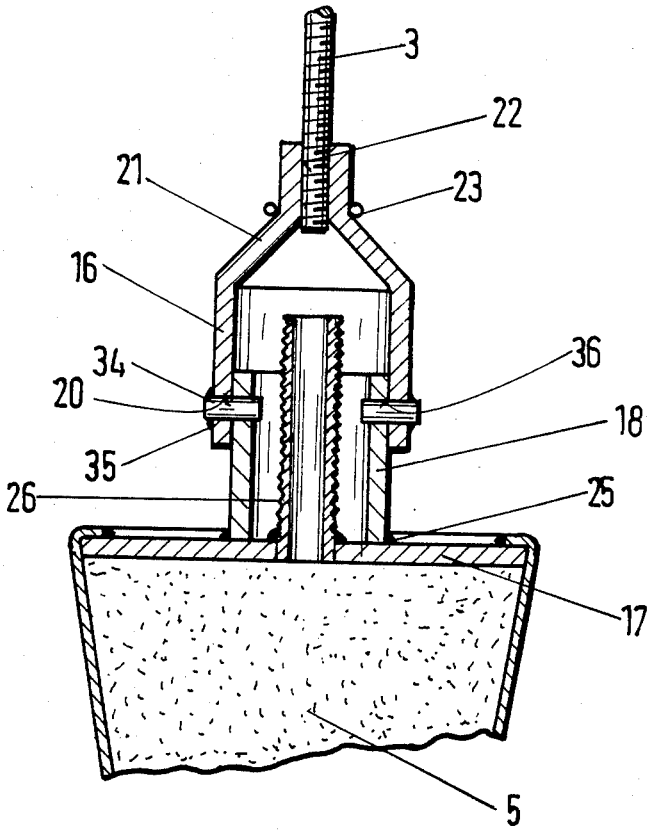
FIG. 4 is a cross section along the line IV—IV in FIG. 3 to an enlarged scale.
Figure 5:
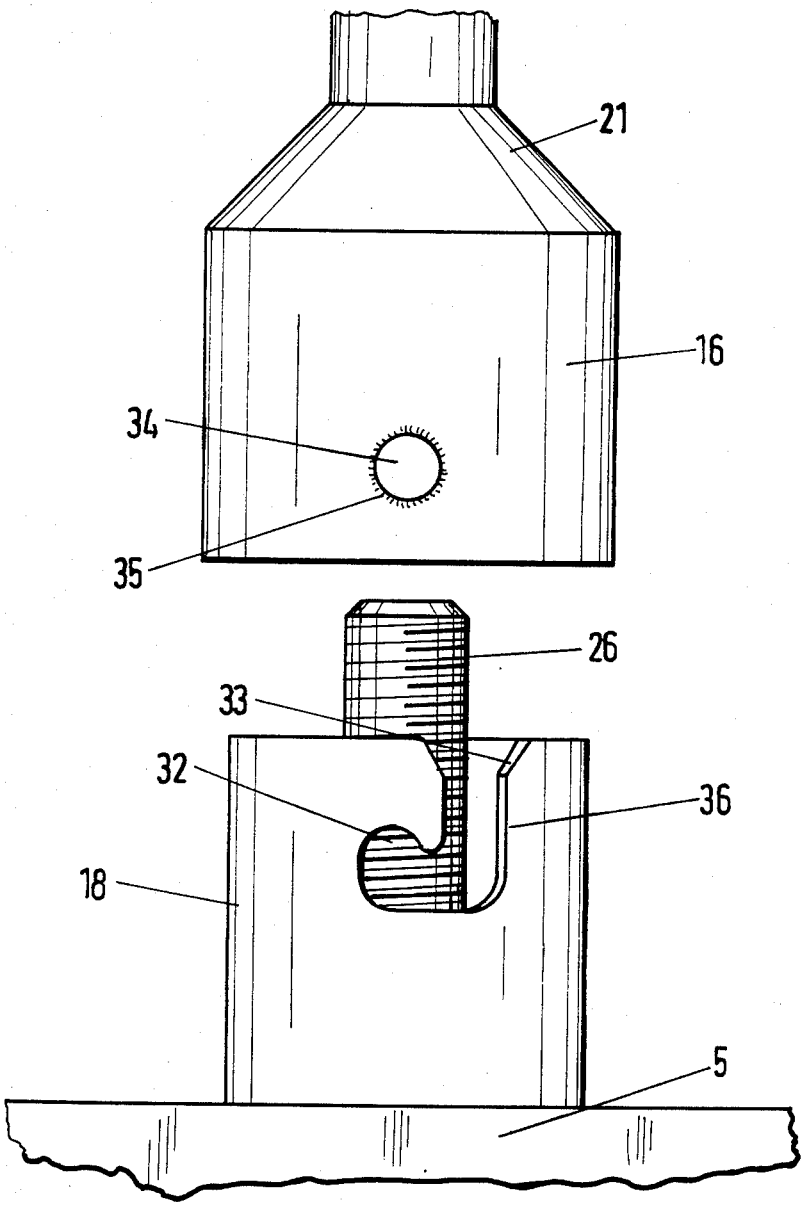
FIG. 5 is a view of the two coupling parts in FIGS. 3 and 4.

In the case of the embodiment of the device illustrated in FIGS. 3 to 5, the structural elements are generally the same as in the embodiment illustrated in FIGS. 1 and 2 and the same reference numerals are therefore used.

The main difference between the two devices is the coupling device. The coupling device 4 in the second embodiment consists of a coupling part 16 arranged at the end of the drawbar 3 and a counter-coupling part 18 arranged upon the sheet-metal end of the gas-purge brick 5. The coupling part 16, connected to the drawbar 3, is in the form of a hollow cylinder and is connected to the drawbar 3 by a conical transition part 21. The latter comprises an extension with a central threaded hole 22 which is screwed to the drawbar 3 which is in the form of a threaded spindle. A peripheral weld 23 secure the coupling part 16 to the drawbar 3 so that they cannot rotate in relation to each other. The coupling part 16 comprises two inwardly projecting studs 34 inserted into holes therein and secured externally with peripheral weld-seams 35.

The counter-coupling part 18 is also in the form of a hollow cylinder, one end thereof being welded at 25 to the sheet-metal end 17 of the gas-purge brick 5. The said counter-coupling part is equipped with two curved slots 36 in which studs 34 engage, one end of the slot having a widening 33 while the other end has a bulge 32.

Arranged concentrically with the counter-coupling part 18, on the gas-purge brick 5, is a gas-connecting pipe 26 which extends to some extent from the said counter-coupling part and is provided with an external thread so that it may be connected to a gas-supply line. It is welded into a central opening in the sheet-metal end 17 of the said gas-purge brick.

The outside diameter of the cylindrical counter-coupling part 18 is somewhat smaller than the inside diameter of the cylindrical coupling part 16, so that the latter may be slipped over the former. When the inwardly projecting studs 34 are thus stopped by the end-face of the counter-coupling part 18, the drawbar is rotated with the coupling part 16 until the studs 34 enter the slots 36 and the coupling parts are locked together by further rotation.

In order to facilitate the handling of the coupling parts 16 and drawbar 3, the handwheel 15 is provided with a transverse hole 31 while the drawbar 3 is provided, at some distance from the lifting piston 14, with an elongated hole 30. Both can be aligned by rotating the handwheel 15 for insertion of a split-pin 37 secured by a chain 38. The said handwheel and drawbar are thus secured against rotation in relation to each other and also axially. The coupling part 16 can thus be rotated and displaced by applying a force to the handwheel.

In order to extract a gas-purge brick from a perforated brick 2, after the coupling parts 16 and 18 have been locked together in the manner described hereinbefore, the split-pin 37 is removed from the handwheel 15 and the latter is rotated towards the cylinder 12 until it bears against the end-face of the lifting piston 14. Pressure is then applied to the cylinder 12 through the feedline 13 which causes the piston to emerge by a specific amount from the cylinder 12, thus carrying the drawbar 3 along with the handwheel. Displacement of the drawbar 3 causes the coupled purge-brick 5 to be extracted from the perforated brick 2, as in the case of the first embodiment.

I claim:

1. A device for extracting a sheet-metal-encased gas-purge brick from a perforated metallurgical vessel, comprising:

a frame adapted to rest upon the exterior of the perforated metallurgical vessel;

a drawbar displaceable axially in the frame in relation to the perforated metallurgical vessel and adatped to be set up in alignment with a centerline of the gas-purge brick;

a coupling device, provided on the drawbar, for coupling the end thereof to the gas-purge brick, said coupling device comprising a coupling part provided at the end of the drawbar and having a cylindrical endsection with two holes disposed at right angles thereto and in alignment with each other, a counter-coupling part provided on the sheetmetal end of the gas-purge brick and including at least one hole disposed at right angles to the axis of the purge-brick, and a coupling pin adapted to be passed through the holes in alignment with each other; and driving means for displacing the drawbar in a direction away from the perforated metallurgical vessel.

2. A device according to claim 1, wherein the gas-purge brick includes a gas-connecting pipe, and the counter-coupling part, provided on the gas-purge brick, comprises a cylinder having two holes in alignment with each other, said cylinder having a length greater than, and concentrically surrounding, said gas-connecting pipe, the distance between the said cylinder holes and the sheet metal end of the gas-purge brick being greater than the length of said gas-connecting pipe.

3. A device according to claim 2, wherein the inside diameter of the cylindrical end-section of the coupling part, provided on the drawbar, is greater than the outside diameter of the cylindrical counter-coupling part fitted to the purge brick.

4. A device according to claim 1, wherein the frame is in the form of a tripod, the three legs being seated upon a central guide-sleeve.

5. A device according to claim 4, wherein a holder is provided on the frame, adjacent the guide-sleeve, for the accommodation of the driving means which displace the drawbar.

6. A device according to claim 5, wherein the driving means is in the form of a hollow-piston-cylinder actuated by a pressure-medium, arranged in alignment with the guide-sleeve, and traversed by the drawbar, the said drawbar being adapted to be locked on or in the hollow piston at least during the extraction process.

7. A device according to claim 1, wherein the drawbar is in the form of a threaded spindle which carries, on the end projecting from the hollow piston and remote from the coupling device, an internally threaded handwheel which is adapted to be screwed towards the end-face of the said hollow piston and can be brought to bear upon a bearing surface on the opposing end-face thereof.

8. Apparatus for extracting a gas-purge brick, having a longitudinal axis, from a perforated metallurgical vessel, said apparatus comprising:

a frame, adapted to rest upon the exterior of the perforated metallurgical vessel, including a drawbar displaceable in the frame forwardly toward and rearwardly away from said perforated metallurgical vessel, the drawbar having a longitudinal axis which is disposed, via said frame, in alignment with the longitudinal axis of the gas-purge brick;

coupling means, provided on one end of the drawbar, for coupling said one end thereof to the gas-purge brick, said coupling means comprising a coupling part provided at the end of the drawbar and having a cylindrical end-section, a cylindrical counter-coupling part extending longitudinally from said gas-purge brick, said coupling part including a plurality of studs inserted in the wall of said cylindrical end-section and projecting therefrom, and said counter-coupling part comprising a plurality of slots corresponding in number to said plurality of studs, each of said slots extending from the forward end of said counter-coupling part and having a width of a size which will accommodate one of said studs, said slots being arranged equally about the periphery of said counter-coupling part forward end, each of said slots including a first portion extending approximately axially of said counter-coupling part and a second locking portion extending at right angles to said first portion, said studs having an exterior configuration adapted to be slidably received in said slots whereby said coupling part and said counter-coupling part can be locked together, and driving means for displacing the drawbar in said rearward direction away from the perforated metallurgical vessel.

9. A device according to claim 8, wherein for the purpose of easy accessibility, the gas-connecting pipe projects beyond the coupling part fitted to the gas-purge brick.

10. A device according to claim 8, wherein the studs project substantially inwardly, the relevant coupling part being larger in diameter than the coupling part provided with the slots.

11. A device according to claim 8, wherein the coupling part carrying the studs is secured to the drawbar.

12. A device according to claim 8, wherein, in order to facilitate the introduction of the studs, the outer ends of the slots on the coupling part are widened.

13. A device according to claim 8, wherein the dead end of each slot is provided with a bulge for engagement with the studs.

14. A device according to claim 8, wherein the studs are of steel rod.

15. A device according to claim 7 having a frame to support the drawbar, displaceable therein, upon the outer wall of the metallurgical vessel, wherein means is provided for locking the handwheel to the threaded spindle.

16. A device according to claim 9, wherein the end of the threaded spindle projecting from the frame comprises a hole or a slot, while the handwheel has a transverse hole, the said spindle and handwheel being adapted to be locked together by means of a split-pin.

17. A gas-purge brick which can be withdrawn from a perforated metallurgical vessel with a device for extracting the gas-purge brick, the device including a frame, adapted to rest upon the exterior of the perforated metallurgical vessel, and including a drawbar displaceable in the frame forwardly toward and rearwardly away from the perforated metallurgical vessel, one end of the drawbar being disposed, via the frame, adjacent a selected surface of the gas-purge brick;

coupling means, including pin means, carried on one end of the drawbar, for coupling the drawbar one end to the gas-purge brick at the selected surface, and driving means for displacing the drawbar in a rearward direction away from the perforated metallurgical vessel, said gas-purge brick having a gas-connecting pipe extending from said selected surface, and including a connecting element, for engagement with the coupling means provided on one end of the extracting device drawbar, said connecting element comprising:

a cylinder welded to said selected surface and surrounding the gas-connecting pipe concentrically, the portion of said cylinder removed from said selected surface including two diametrically disposed holes in alignment with each other for receiving said pin means.

18. A gas-purge brick according to claim 17, wherein said cylinder is shorter than said connecting pipe, and said two diametrically disposed holes each comprise slots having a first portion extending toward said selected surface in a first approximately axial direction and a second, locking portion extending at right angles to the said first portion.

19. In combination, a system for treating melts in the interior of a metallurgical vessel with purging gases, said system comprising:

a gas purge brick insertable through an opening in a face of the metallurgical vessel, and an extraction device facilitating removal of said gas purge brick from the interior of the metallurgical vessel, through the opening, when said gas purge brick requires replacement, said gas purge brick including a first surface which, when said brick has been inserted into the interior of the metallurgical vessel, faces in a first direction toward the opening, a gas-connecting pipe communicating the interior of said gas purge brick with the ambient, said gas-connecting pipe extending in said first direction and terminating in a free end, and a cylindrical coupling element having a body portion extending away from said first surface, a first end secured to said first surface and a second coupling end, removed from said first end and said first surface, said extraction device including a frame adapted to rest, atop the opening, upon the face of the metallurgical vessel, a drawbar displaceable in the frame forwardly toward, and rearwardly away from, the face of the metallurgical vessel, one end of said drawbar being disposed, via the frame, adjacent said first surface of said gas purge brick when said brick is disposed in the interior of the metallurgical vessel, coupling means, including pin means, carried on said one end of said drawbar, for coupling said drawbar one end to the second coupling end of the coupling element of said gas purge brick, and means for displacing said drawbar in a rearward direction away from the face of the metallurgical vessel when said coupling means is coupled to the second coupling end of the coupling element of said gas purge brick.

20. The system of claim 19, wherein said second coupling end of said coupling element includes diametrically opposed openings, and said pin means of said extraction device coupling means comprises means for engaging in said diametrically opposed openings, whereby upon securing said drawbar one end to said coupling element of said gas purge brick by engaging said pin means in said diametrically opposed openings, said means for displacing said drawbar in a rearward direction may be actuated and said gas purge brick may be removed from the interior of the metallurgical vessel.

21. The system of claim 20, wherein said second coupling end of said coupling element is disposed farther from said first surface of said gas purge brick than said free end of said gas connecting pipe.

22. The system of claim 21, wherein said pin means comprises a single pin extending diametrically across said cylindrical coupling element and engaging in said diametrically opposed openings.

23. The system of claim 20, wherein said second coupling end of said coupling element is disposed closer to said first surface of said gas purge brick than said free end of said gas connecting pipe.

24. The system of claim 23, wherein said pin means comprises a pair of diametrically opposed pins carried by said coupling means, each of said pins engaging in a respective one of said diametrically opposed openings.

25. In a gas purge brick, insertable through an opening in a surface of a metallurgical vessel, for treating melts in the interior of the metallurgical vessel with purging gases, the improvement comprising:

a first surface, which when the brick has been inserted into the interior of a metallurgical vessel, faces the opening;

a gas-connecting pipe for communicating the interior of said gas purge brick with the ambient, said gas-connecting pipe extending in said first direction and terminating in a free end, and a cylindrical coupling element having a body portion extending away from said first surface in said first direction, a first end secured to said first surface and a second coupling end, removed from said first end and said first surface, the region of said body portion adjacent said second coupling end of said cylindrical coupling element including diametrically opposed openings for engagement by a tool used to extract the gas purge brick from the metallurgical vessel.

26. The gas purge brick of claim 25, wherein said free end of said gas-connecting pipe extends further away from said first surface than said second coupling end of said cylindrical coupling element, and said openings comprise a J-shaped slot including a slot portion extending in said first direction to said second coupling end.

27. The gas purge brick of claim 25, wherein said second coupling end of said cylindrical coupling element extends further away from said first surface than said free end of said gas-connecting pipe, and said openings disposed in said region of said body portion are isolated from said second coupling end.

* * * * *